US007038386B2

(12) United States Patent
Nozaki

(10) Patent No.: US 7,038,386 B2
(45) Date of Patent: May 2, 2006

(54) HIGH-PRESSURE DISCHARGE LAMP AND FABRICATION METHOD OF THE SAME

(75) Inventor: Hitoshi Nozaki, Tokyo (JP)

(73) Assignee: NEC Corporation, Tokyo (JP)

( * ) Notice: Subject to any disclaimer, the term of this patent is extended or adjusted under 35 U.S.C. 154(b) by 147 days.

(21) Appl. No.: 10/443,548

(22) Filed: May 22, 2003

(65) Prior Publication Data

US 2003/0222583 A1 Dec. 4, 2003

(30) Foreign Application Priority Data

May 28, 2002 (JP) ..... 2002-153809

(51) Int. Cl.
*H01J 17/16* (2006.01)
*H01J 61/30* (2006.01)
*H01J 17/04* (2006.01)

(52) U.S. Cl. ..... 313/634; 313/631

(58) Field of Classification Search ..... 313/634, 313/631

See application file for complete search history.

(56) References Cited

U.S. PATENT DOCUMENTS 4,851,733 A * 7/1989 Kuus et al. ..... 313/331
5,783,907 A * 7/1998 Suzuki et al. ..... 313/625
6,703,136 B1 * 3/2004 Niimi ..... 428/469

FOREIGN PATENT DOCUMENTS

| | | |
|---|---|---|
| JP | 6-20653 | 1/1994 |
| JP | H6-208831 | 7/1994 |
| JP | 9-115484 | 5/1997 |
| JP | 11-154491 | 6/1999 |
| JP | 2000-277053 | 10/2000 |
| JP | 2001-23570 | 1/2001 |
| JP | 2001-35444 | 2/2001 |

* cited by examiner

*Primary Examiner*—Mariceli Santiago
*Assistant Examiner*—Elizabeth Rielley
(74) *Attorney, Agent, or Firm*—Muirhead and Saturnelli, LLC

(57) ABSTRACT

A high-pressure discharge lamp includes a bulb that is made from glass in which a discharge space has been formed and a pair of electrode assemblies that are sealed in the end portions of this bulb. The electrode assemblies are each provided with an electrode rod for electrical discharge, and the electrode assemblies are sealed in the bulb with one part of each electrode rod extending into the discharge space. The part of each electrode assembly that is sealed in the bulb is in turn enclosed in an intermediate part. This intermediate part has a thermal expansion coefficient that is between the thermal expansion coefficient of the electrode rod and the thermal expansion coefficient of the bulb, is interposed between the electrode assembly and the bulb, and adheres to both the electrode assembly and the bulb.

12 Claims, 6 Drawing Sheets

HIGH-PRESSURE DISCHARGE LAMP AND FABRICATION METHOD OF THE SAME

BACKGROUND OF THE INVENTION

1. Field of the Invention

The present invention relates to a high-pressure discharge lamp and to a method of fabricating the high-pressure discharge lamp.

2. Description of the Related Art

FIG. 1 shows a sectional view of a high-pressure discharge lamp of the prior art. High-pressure discharge lamp 101 shown in FIG. 1 includes bulb 102 made of quartz glass and two electrode assemblies 106 that are held at the two end portions of bulb 102. Each of electrode assemblies 106 is constructed such that electrode rod 103 made of tungsten, molybdenum foil 104, and lead-in rod 105 are connected together in a series by welding. The electrode rod 103 side of each of electrode assemblies 106 is inserted into bulb 102, and the electrode assemblies 106 are held hermetically in bulb 102 with the tip portion of electrode rod 103 extending into discharge space 102*a* of bulb 102. The portions at which bulb 102 holds electrode assembly 106 are referred to as sealing portions.

Methods of holding electrode assemblies 106 in bulb 102 include a pinch-sealing method and a shrink-sealing method. The pinch-sealing method involves heating and softening the portions that are to become the sealing portions of bulb 102 with electrode assemblies 106 inserted in bulb 102 and then pressing the softened portions to closely adhere bulb 102 to electrode assemblies 106. The shrink-sealing method involves evacuating the interior of bulb 102 with electrode assemblies 106 inserted into bulb 102, and then heating and softening the portions that are to become the sealing portions such that the softened portions are caused to shrink in the radial direction, causing bulb 102 to closely adhere to electrode assemblies 106.

Thus, the electrode assemblies are sealed directly to the glass bulb of a high-pressure discharge lamp of the prior art. However, depending on the sealing conditions, innumerable cracks can occur in the sealing portion of the bulb due to the difference in thermal expansion between the electrode assemblies and bulb when the bulb is heated in the process of sealing the electrode assemblies. In a typical high-pressure discharge lamp, several hundred atmospheres of pressure are produced in the discharge space when the lamp is lit up. The repetition of turning a high-pressure discharge lamp ON and OFF causes these cracks that occur in the sealing portion to progress, and this progression eventually results in the rupture of the bulb.

A high-pressure discharge lamp that is directed to eliminating this occurrence of cracking when sealing the electrode assemblies is disclosed in Japanese Patent Laid-Open No. H11-154491. In this high-pressure discharge lamp, a portion of the electrode rods of the electrode assemblies is sealed in advance to a glass part having the same composition as the bulb, and the electrode assemblies are then sealed to the bulb by way of this glass part.

As another example, Japanese Patent Laid-Open No. 2001-23570 discloses a high-pressure discharge lamp in which a peel layer is formed on the surface of the position of the bulb at which electrode rods are to be sealed. The electrode rods undergo greater contraction than the bulb during cooling in the step of sealing the electrode assemblies, but this peeling layer is provided for facilitating the separation of the electrode rods from the bulb at this time and prevents the formation of cracks in the bulb. Examples of the peeling layer in this publication include a metal thin-film, a metallic base, and an oxide film.

Nevertheless, the above-described high-pressure discharge lamps of the prior art have problems as described below.

First, although the lamp described in Japanese Patent Laid-Open No. H11-154491 can prevent the formation of cracks in the bulb when the electrode assemblies that have been sealed to the glass part are sealed to the bulb, it will be likely for cracks to form in the glass parts when sealing the electrode assemblies to the glass parts, resulting in the same problem as the previously described prior art.

In the lamp that is described in Japanese Patent Laid-Open No. 2001-23570, on the other hand, considerable difficulty is encountered in forming the peeling layers on the surface of the bulb at which the electrode assemblies are to be sealed. In addition, the formation of the peeling layer causes change in the internal capacity of the discharge space, and substances that are sealed inside the discharge space may enter the gap that occurs between the peeling layer and the electrode rods. As a result, the pressure in the discharge space may fall below the prescribed pressure and the prescribed luminance may be difficult to achieve. In addition, the material that is used to form the peeling layer may itself form an impurity and lead to a shortening of the service life of the lamp.

In addition to the above-described occurrence of cracks in a high-pressure discharge lamp in which the electrode assemblies are sealed directly to the bulb, the deformation of the molybdenum foil (metal foil) that forms a portion of the electrode assemblies may result in the problem of decentering of the electrode rods. Decentering of the electrode rods causes the arc discharge that occurs when the lamp is lit up to approach the inner walls of the bulb and therefore causes a local increase in the temperature of the bulb. This local increase in temperature leads to a loss of transparency of the inner wall of the bulb and a drop in the brightness of the lamp. In addition, the focal point of the lamp may shift, whereby the emitted light falls below the designed level and the prescribed brightness cannot be obtained.

As a construction for preventing deformation of the metal foil, a construction is disclosed in Japanese Patent Laid-Open No. 2001-23570 in which metal foil is sealed by a glass part. Although the metal foil is reinforced by the glass part in this construction, it will be yet likely for cracks to occur in the glass part when sealing the metal foil, as with the construction that is disclosed in Japanese Patent Laid-Open No. H11-154491.

SUMMARY OF THE INVENTION

It is the first object of the present invention both to provide a high-pressure discharge lamp that can easily and reliably prevent the occurrence of cracks when sealing the electrode assemblies and that can improve resistance to pressure, and to provide a method of fabricating such a high-pressure discharge lamp.

It is the second object of the present invention to both provide a high-pressure discharge lamp that prevents deformation of the metal foil when sealing the electrode assemblies in the bulb and that consequently prevents decentering of the electrode assemblies, and to provide a method of fabricating such a high-pressure discharge lamp.

To achieve the above-described objects, the high-pressure discharge lamp of the present invention includes: a bulb made of glass in which a discharge space is formed; a pair of electrode assemblies that are each provided with an electrode rod for discharge and that are each sealed in respective end portions of the bulb such that a portion of the electrode rod extends into the discharge space; and intermediate parts that each surround the part of respective electrode assemblies that is to be sealed, that are each interposed between respective electrode assemblies and the bulb, and that adhere to both the respective electrode assemblies and bulb. Further, the intermediate parts in the high-pressure discharge lamp of the present invention have a thermal expansion coefficient that is between the thermal expansion coefficient of the electrode rods and the thermal expansion coefficient of the bulb.

The method of fabricating the high-pressure discharge lamp of the present invention includes steps of: fabricating a pair of electrode assemblies each having an electrode rod for electrical discharge; sealing each of the electrode assemblies, excepting a portion of the electrode rods, in respective intermediate parts to fabricate a pair of sealed assemblies; and sealing each of the sealed assemblies in respective end portions of a bulb made of glass in which a discharge space is formed such that the portions of the electrode rods that are not sealed in the intermediate parts extend into the discharge space. In the method of fabricating a high-pressure discharge lamp of the present invention, at least one type of material having a thermal expansion coefficient that is between the thermal expansion coefficient of the electrode rods and the thermal expansion coefficient of the bulb is used as the intermediate parts.

Interposing an intermediate part having this type of thermal expansion coefficient between an electrode assembly and the bulb according to the present invention reduces the difference in thermal expansion between each of the parts when sealing the electrode assemblies to the bulb. The present invention therefore not only enables a suppression of the occurrence of cracks in the bulb, but can also improve the resistance to pressure of the high-pressure discharge lamp. Accordingly, the service life of the high-pressure discharge lamp can be improved, and the operating pressure can be raised to obtain an improvement in luminance. Moreover, the high-pressure discharge lamp of the present invention can be readily fabricated using the fabrication technology for typical high-pressure discharge lamps.

In the electrode assemblies in the present invention, the electrode rods, metal foil, and lead electrodes may be connected in a series. In this case, the metal foil is protected by the intermediate part before being sealed in the bulb. This approach prevents deformation of the metal foil when sealing the electrode assemblies in the bulb and thus prevents decentering of the electrode rods, which is one cause of a reduction in the brightness of a high-pressure discharge lamp.

The above and other objects, features, and advantages of the present invention will become apparent from the following description with reference to the accompanying drawings, which illustrate examples of the present invention.

DETAILED DESCRIPTION OF THE PREFERRED EMBODIMENTS

Figure 1:
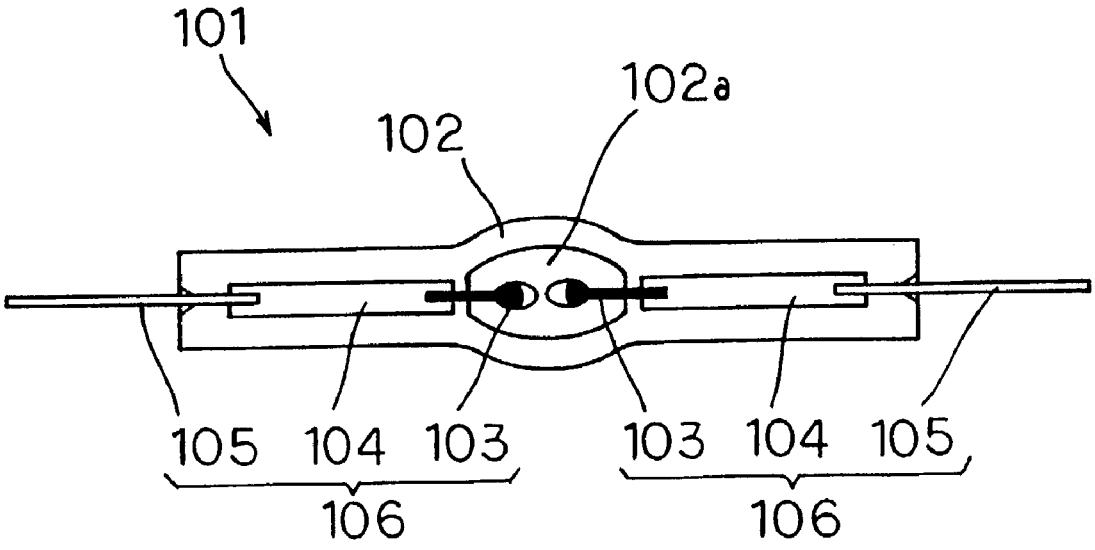
Fig. 1 Prior Art
FIG. 1 is a sectional view of a high-pressure discharge lamp of the prior art.
Figure 2:
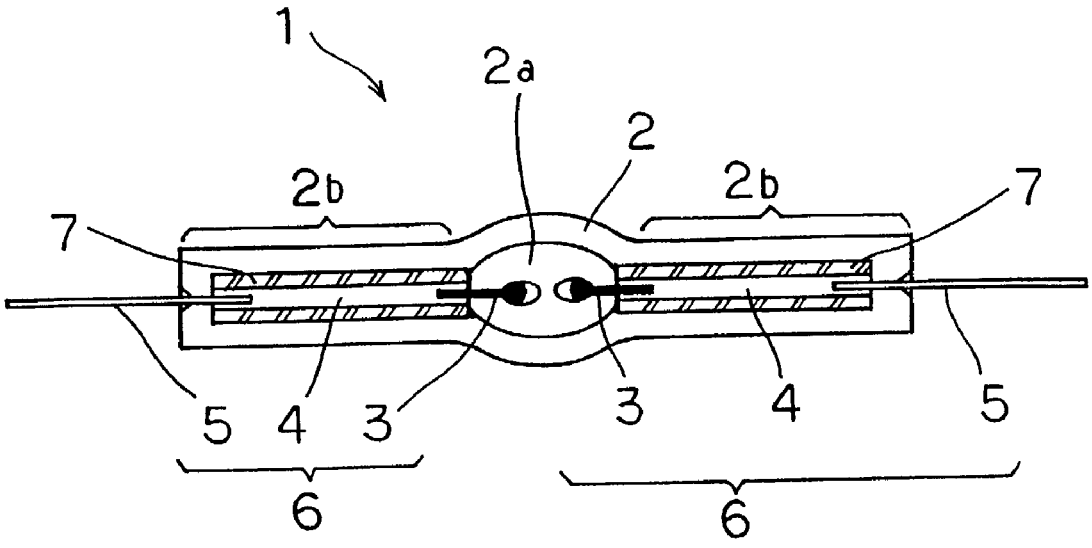
FIG. 2 is a sectional view of a high-pressure discharge lamp according to an embodiment of the present invention.

The high-pressure discharge lamp shown in FIG. 2 includes: bulb 2 in which the central portion is discharge space 2*a*; a pair of electrode assemblies 6 each positioned at respective end portions of bulb 2; and intermediate parts 7 that each seal a portion of respective electrode assemblies 6 and that are each interposed between respective electrode assemblies 6 and bulb 2.

Bulb 2 is made of quartz glass. The interior of discharge space 2*a* of bulb 2 is charged with mercury at a ratio of 0.12–0.30 mg/mm$^3$ and halogen gas at a ratio of $10^{-8}$–$10^{-2}$ μmol/mm$^3$. The two end portions of bulb 2 are sealing portions 2*b*; and electrode assemblies 6, which are each sealed in respective intermediate parts 7, are held in a hermetically sealed state at sealing portions 2*b*.

Electrode assemblies 6 are each constructed such that discharge electrode rod 3, made of tungsten, molybdenum foil 4, and lead-in rod 5, which serves as the lead electrode to the outside, are connected in a series. Each electrode assembly 6 is held in bulb 2 such that the end portion of electrode rod 3 extends into discharge space 2*a*. In addition, a portion of lead-in rod 5 is exposed on the outside of bulb 2.

Each intermediate part 7 seals the portions of respective electrode assemblies 6 that are sealed in sealing portion 2*b*, i.e., molybdenum foil 4, the portion of electrode rod 3 that is adjacent to molybdenum foil 4, and the portion of lead-in rod 5 that is adjacent to molybdenum foil 4, in which they are held in air-tight in respective sealing portions 2*b* of bulb 2. Intermediate parts 7 are made of a material that has a thermal expansion coefficient that is between the thermal expansion coefficient of bulb 2 and the thermal expansion coefficient of rod electrodes 3.

Of those materials having these properties, glass is preferably used as intermediate part 7, Vycor Glass (trade name) manufactured by Corning Inc. and GB Glass (trade name) manufactured by GBGlass, Inc. being specific examples of preferable materials. Glass material allows easy sealing of the above-described portion of electrode assemblies 6 by softening, and moreover, can hold electrode assemblies 6 without deformation after hardening.

For reference, we indicate the thermal expansion coefficients of bulb 2, electrode rods 3, and intermediate parts 7 that are used in the present embodiment. The thermal expansion coefficient of bulb 2 is $5.4\times10^{-7}$/° C., the thermal expansion coefficient of electrode rods 3 is $32\times10^{-7}$/° C., and the thermal expansion coefficient of intermediate parts 7 is $8.0\times10^{-7}$–$20\times10^{-7}$/° C.

We next refer to FIGS. 3–8 to describe an example of the method of fabricating above-described high-pressure discharge lamp 1.

Figure 3:
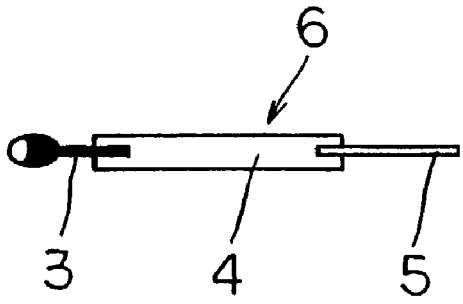
FIG. 3 is an explanatory view of one example of the method of fabricating the high-pressure discharge lamp shown in FIG. 2 and shows the state of fabricating an electrode assembly.

First, as shown in FIG. 3, electrode rod 3, molybdenum foil 4, and lead-in rod 5 are connected in a series in that order to produce electrode assembly 6. The connection between electrode rod 3 and molybdenum foil 4 and the connection between molybdenum foil 4 and lead-in rod 5 are each made by welding.

Figure 4:
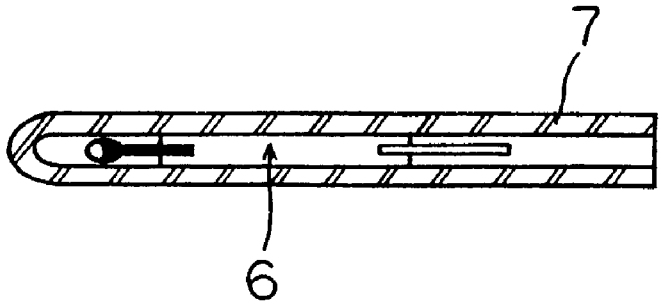
FIG. 4 is an explanatory view of an example of the method of fabricating the high-pressure discharge lamp shown in FIG. 2 and shows the state in which an electrode assembly has been inserted in an intermediate part.

Next, as shown in FIG. 4, electrode assembly 6 is inserted into intermediate part 7, which is formed in a tubular shape.

Figure 5:
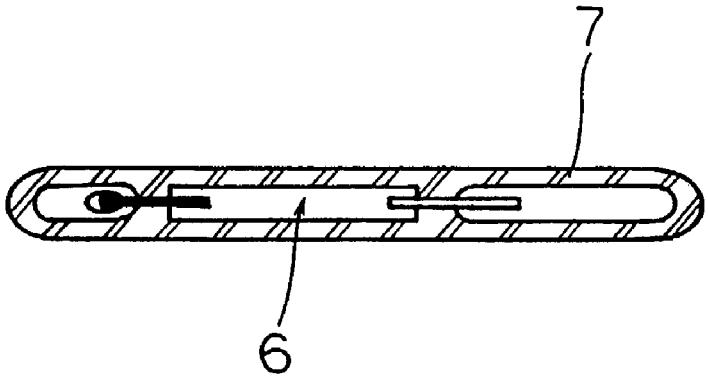
FIG. 5 is an explanatory view of an example of the method of fabricating the high-pressure discharge lamp shown in FIG. 2, and shows the state in which an electrode assembly has been sealed in an intermediate part.

Then, as shown in FIG. 5, the above-described portion of electrode assembly 6 is sealed in intermediate part 7. This sealing of electrode assembly 6 can be effected through the use of a pinch-sealing or shrink-sealing method. If a pinch-sealing method is employed, intermediate part 7 is first heated to soften intermediate part 7. The portions of intermediate part 7 that seal electrode assembly 6 are then crimped, thereby sealing electrode assembly 6. If a shrink-sealing method is used, the interior of intermediate part 7 is first evacuated to produce a vacuum. The portions of intermediate part 7 that seal electrode assembly 6 are then heated in this state to soften these portions. The softened portions of intermediate part 7 thus contract in a radial direction and come into close contact with electrode assembly 7, thereby sealing electrode assembly 6.

In the shrink-sealing method, an even force is applied to the circumference of intermediate part 7, and electrode assembly 6 can therefore be sealed without causing deformation such as twisting or bending of electrode assembly 6. The shrink-sealing method is therefore the method preferably used as the method for sealing electrode assembly 6 that includes easily deformable molybdenum foil 4.

Figure 6:
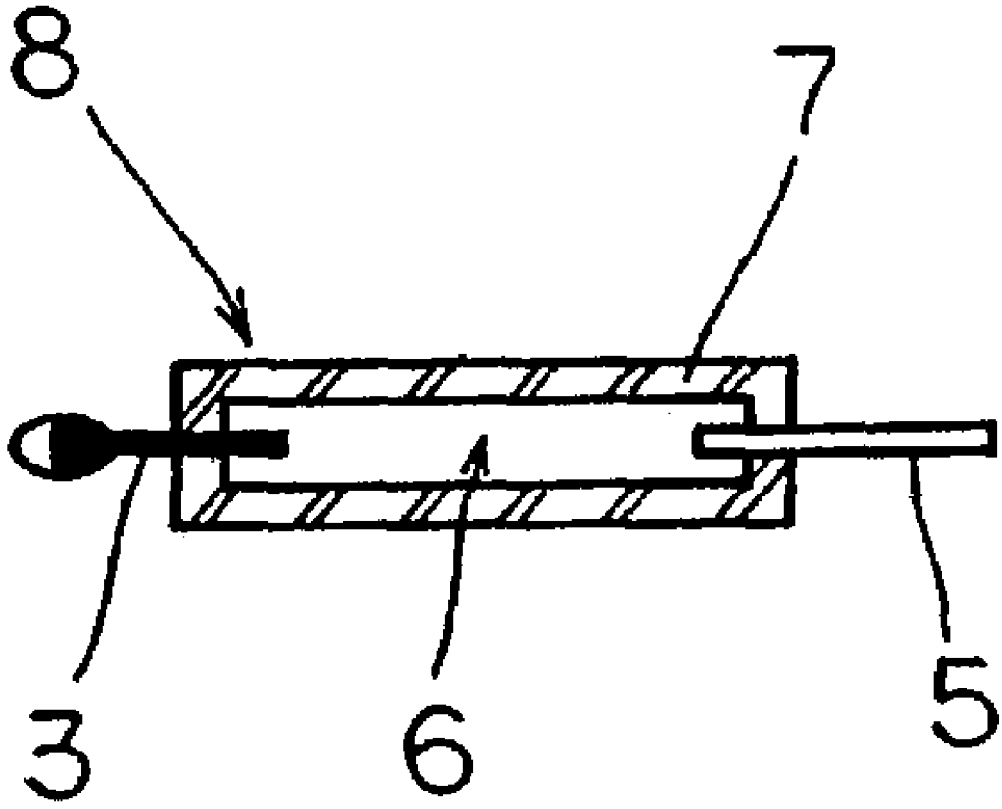
FIG. 6 is an explanatory view of an example of the method of fabricating the high-pressure discharge lamp shown in FIG. 2 and shows the state in which unnecessary portions of an intermediate part have been removed.

Next, as shown in FIG. 6, the portions of intermediate part 7 that do not seal electrode assembly 6 (the points of intermediate part 7 that are not in close contact with electrode assembly 6) are cut and removed, whereby sealed assembly 8 is obtained in which electrode assembly 6 is sealed in intermediate part 7 such that a portion of electrode rod 3 and a portion of lead-in rod 5 are exposed. Two sealed assemblies 8 are used for one high-pressure discharge lamp 1 (refer to FIG. 2) and are sealed one at a time in bulb 2.

The sealing of two sealed assemblies 8 in bulb 2 can be realized by the pinch-sealing method or by the shrink-sealing method. The procedure for sealing by the shrink-sealing method is next described.

Figure 7:
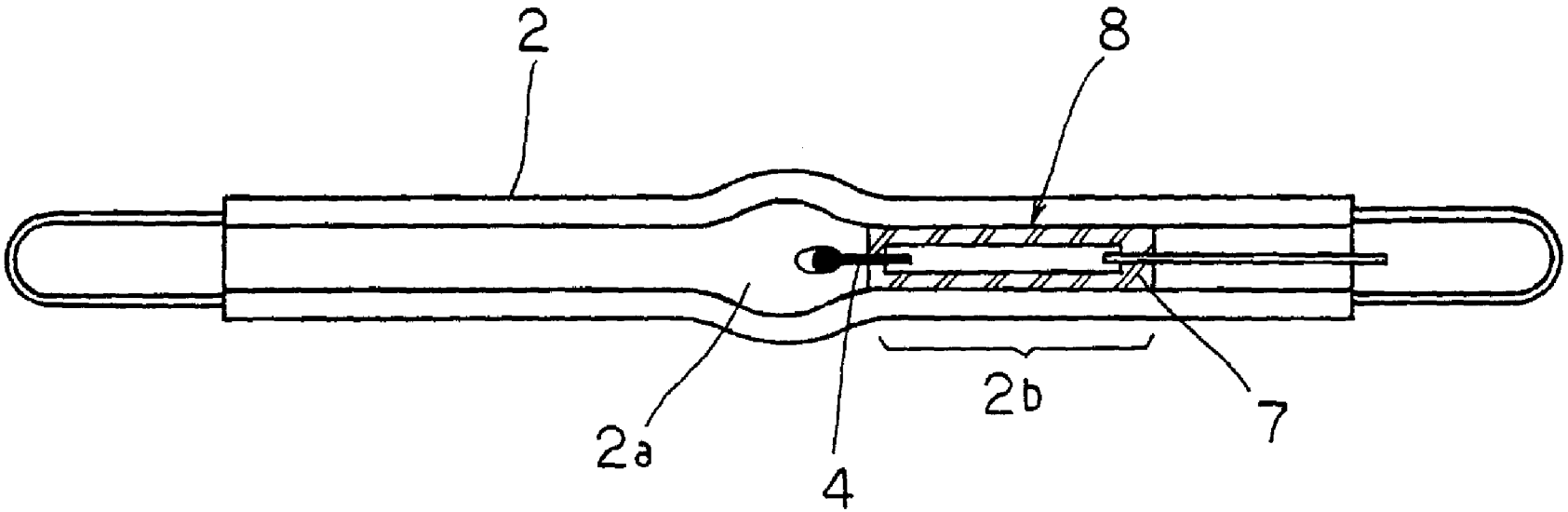
FIG. 7 is an explanatory view of an example of the method of fabricating the high-pressure discharge lamp shown in FIG. 2 and shows the state in which a sealed assembly has been inserted in a bulb.

As shown in FIG. 7, the electrode rod 3—side end of one sealed assembly 8 is inserted into one end of bulb 2. Sealed assembly 8 is inserted into bulb 2 until intermediate part 7 is positioned at sealing portion 2*b* of bulb 2, or in other words, until the portion of electrode rod 3 that is not sealed in intermediate part 7 is positioned in discharge space 2*a* of bulb 2.

Figure 8:
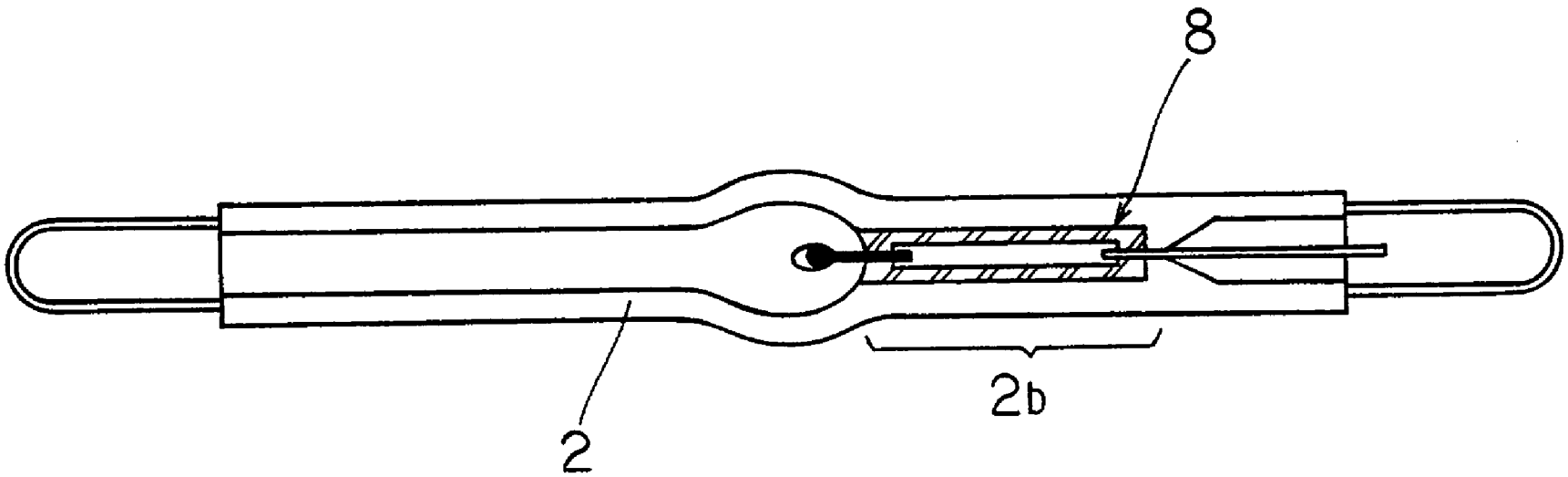
FIG. 8 is an explanatory view of an example of the method of fabricating the high-pressure discharge lamp shown in FIG. 2 and shows the state in which a sealed assembly has been sealed in a bulb.

After sealed assembly 8 has been inserted to the above-described prescribed position of bulb 2, the interior of bulb 2 is evacuated in that state to produce a vacuum. Sealing portion 2*b* of bulb 2 on the side in which sealed assembly 8 has been inserted is then heated to soften this portion, whereby, as shown in FIG. 8, sealing portion 2*b* of bulb 2 contracts in its radial direction and comes into close contact with sealed assembly 8, whereby sealed assembly 8 is sealed at sealing portion 2*b*.

After the sealing of sealed assembly 8 has been completed for one sealing portion 2*b*, the other sealed assembly 8 is similarly sealed at sealing portion 2*b* on the opposite side of bulb 2. When sealing the other sealed assembly 8, however, the interior of bulb 2 is evacuated to a vacuum state and mercury and halogen gas are then introduced into the interior of bulb 2 at a ratio of 0.12–0.30 mg/mm$^3$ and $10^{-8}$–$10^{-2}$ μmol/mm$^3$, respectively.

Finally, both end portions of bulb 2 are cut and removed, thereby completing fabrication of high-pressure discharge lamp 1 as shown in FIG. 2.

According to high-pressure discharge lamp 1 of the present embodiment, the interposition of intermediate part 7 between electrode assembly 6 and bulb 2 prevents direct contact between electrode assembly 6 and bulb 2. Intermediate part 7 is made of a material having a thermal expansion coefficient that is between the thermal expansion coefficient of electrode rod 3 and the thermal expansion coefficient of bulb 2. Thus, compared with a case in which electrode assemblies 6 are sealed directly in bulb 2, an extremely simple construction is used to substantially reduce the differences in thermal expansion of each of the parts that occur when heat is applied when sealing electrode assemblies 6 and when sealing sealed assemblies 8. The present embodiment therefore reduces residual strain and suppresses the occurrence of cracking at sealing portions 2*b*, and therefore improves the pressure resistance of high-pressure discharge lamp 1.

The improvement in pressure resistance reduces the danger of rupture of high-pressure discharge lamp 1 despite the repetitions of turning high-pressure discharge lamp 1 ON and OFF, effectively improves the reliability of high-pressure discharge lamp 1, and achieves a longer service life of high-pressure discharge lamp 1. The improvement in pressure resistance also allows an increase in the operating pressure of high-pressure discharge lamp 1. The operating pressure has an effect on the luminance of high-pressure discharge lamp 1, and an increase in the operating pressure improves the luminance, and accordingly, enables an improvement in color rendering. More specifically, when bulb 2, electrode rods 3, and intermediate parts 7 are each formed of materials having the above-described thermal expansion coefficients, an operating pressure of $2.6\times10^7$ Pa can be realized. The operating pressure that was realized when electrode assemblies 6 are directly sealed in bulb 2 without using intermediate parts 7 was $2.0\times10^7$ Pa, and the use of intermediate parts 7 therefore enables an improvement in operating pressure of approximately 30%.

Intermediate parts 7 can be realized by any commercially available material and do not necessitate the use of any special material as long as the thermal expansion coefficient of intermediate parts 7 is within a prescribed range. In addition, the sealing of electrode assemblies 6 in intermediate parts 7 can be effected by a method that is typically used to seal electrode assemblies 6 in bulb 2. High-pressure discharge lamp 1 according to the present invention therefore facilitates fabrication.

The processes of sealing electrode assemblies 6 in bulb 2 as sealed assemblies 8 that are sealed in intermediate parts 7 can also prevent the deformation of electrode assemblies 6 when electrode assemblies 6 are sealed in bulb 2, and in particular, can prevent the deformation of molybdenum foil 4. The present invention therefore enables a suppression of decentering of electrode rods 3 with respect to bulb 2, and as a result, can obtain a superior high-pressure discharge lamp 1 in which the reduction in brightness of high-pressure discharge lamp 1 that could be brought about by decentering of electrode rods 3 is eliminated.

Another embodiment of the present invention will be described below.

Figure 9:
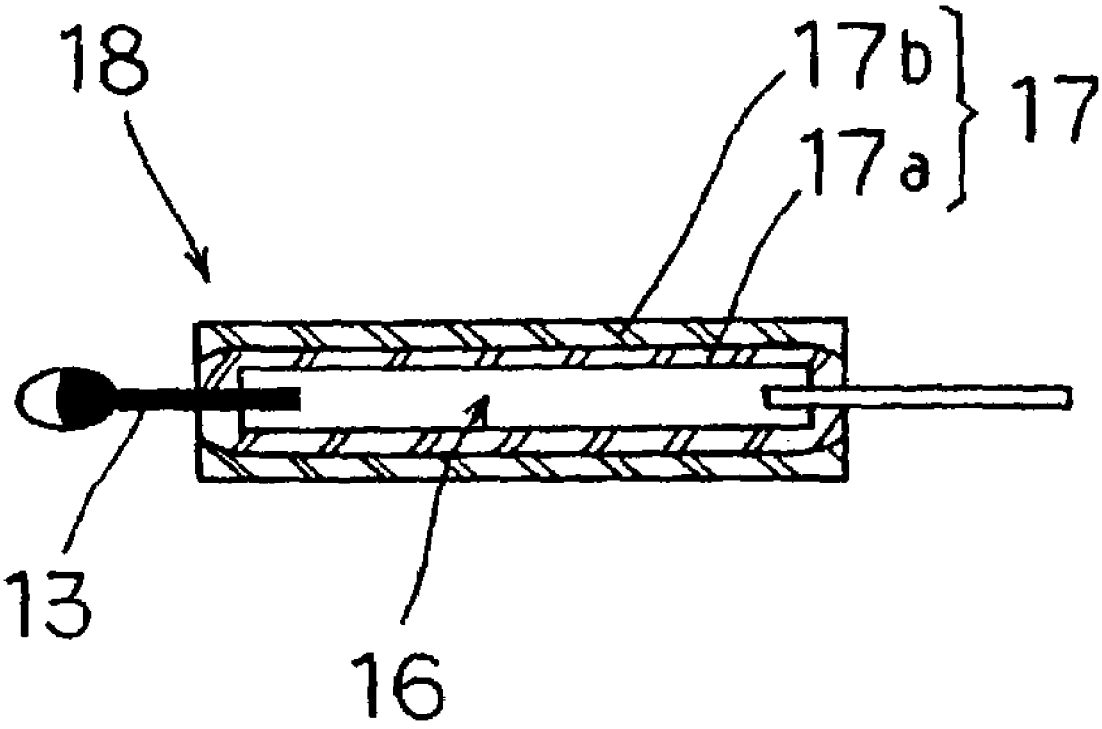
FIG. 9 is a sectional view of a sealed assembly according to another embodiment of the present invention.

Although an example was described in the previously described embodiment in which intermediate parts 7 were made of a single material, intermediate parts 7 may also be made of various types of materials. FIG. 9 shows a sectional view of a sealed assembly in which the intermediate part is made of various types of materials. Sealed assembly 18 that is shown in FIG. 9 includes electrode assembly 16 and intermediate part 17 that seals prescribed points of electrode assembly 16. The high-pressure discharge lamp is then constructed by sealing a pair of sealed assemblies 18 at both ends of a bulb (not shown) as shown in FIG. 2.

Electrode assembly 16 is constructed similarly to the assembly that is shown in FIG. 3, and a redundant description of the details of this construction is therefore here omitted. Intermediate part 17 has a two-layer construction that includes inner first layer 17*a* that is closely bonded to electrode assembly 16 and outer second layer 17*b* that is closely bonded to the bulb when sealed in the bulb. First layer 17*a* and second layer 17*b* are made of materials that have different thermal expansion coefficients. More specifically, the thermal expansion coefficient of first layer 17*a* has a value that is between the thermal expansion coefficient of electrode rod 13 of electrode assembly 16 and the thermal expansion coefficient of second layer 17*b*; and moreover, the thermal expansion coefficient of second layer 17*b* has a value that is between the thermal expansion coefficient of first layer 17*a* and the thermal expansion coefficient of the bulb. In other words, the thermal expansion coefficients of electrode rod 13, first layer 17*a*, second layer 17*b*, and the bulb each have values that progressively decrease in that order.

This stepped change in the thermal expansion coefficients of the materials of intermediate part 17 itself enables a further reduction in the difference in thermal expansion coefficient between parts that are in close contact. As a result, a further suppression of cracking in the sealing portions of the high-pressure discharge lamp can be obtained.

First layer 17*a* and second layer 17*b* can each be made of a glass material. In addition, intermediate part 17 having a two-layer construction as in the present embodiment may be constructed as a part that itself has a two-layer construction, or first layer 17*a* and second layer 17*b* may be constructed as separate parts. When intermediate part 17 is itself constructed as a part having two-layer construction, sealed assembly 18 can be fabricated by means of steps similar to the steps described with reference to FIGS. 4 to 6 using intermediate part 17 that is constructed in a tubular form. When each of layers 17*a* and 17*b* of intermediate part 17 are constructed as separate parts, on the other hand, sealed assembly 18 in which intermediate part 17 is effectively of a two-layer construction can be fabricated by repeating each of the steps that were explained with reference to FIGS. 4 to 6 using parts that are each constructed in a tubular shape for each of layers 17*a* and 17*b* and in order starting from the part having the largest thermal expansion coefficient. The elimination of unnecessary portions of intermediate part 17 by cutting may be carried out upon the completion of each sealing step, or may be carried out collectively as a final step.

Although an intermediate part of two-layer construction is shown in FIG. 9, the intermediate part may have a construction of three or more layers to further reduce differences in thermal expansion coefficients. In such a case, the layers of the intermediate part are formed of various types of materials such that the thermal expansion coefficients of these materials decrease step-wise from the side of the electrode assembly toward the bulb.

Although certain preferred embodiments of the present invention have been shown and described in detail, it should be understood that various changes and modifications may be made without departing from the spirit or scope of the appended claims.

What is claimed is:

1. A high-pressure discharge lamp, comprising:

a bulb made of glass in which a discharge space is formed;

a pair of electrode assemblies that are each provided with an electrode rod for electrical discharge and that are each sealed in respective end portions of said bulb such that a portion of said electrode rod extends into said discharge space, wherein each of said electrode assemblies includes said electrode rod, a lead electrode to the outside, and metal foil interposed between said electrode rod and said lead electrode; and intermediate parts that each surround said metal foil and portions of said electrode rod and said lead electrode, that are each interposed between respective said electrode assemblies and said bulb, and that adhere to both said respective electrode assemblies and said bulb, wherein said intermediate parts have a thermal expansion coefficient that is between the thermal expansion coefficient of said electrode rods and the thermal expansion coefficient of said bulb.

2. A high-pressure discharge lamp according to claim 1, wherein said intermediate parts are constructed of a glass material.

3. A high-pressure discharge lamp according to claim 1, wherein said intermediate parts have thermal expansion coefficients in decreasing order stepwise from said electrode assembly side toward said bulb side.

4. A high-pressure discharge lamp according to claim 3, wherein said intermediate parts have a multiple-layer structure that comprises a plurality of layers each having a different thermal expansion coefficient.

5. A high-pressure discharge lamp according to claim 1, wherein said intermediate parts include a first layer that is closely bonded to said electrode assembly and a second layer that is closely bonded to the bulb when sealed in the bulb.

6. A high-pressure discharge lamp, according to claim 5, wherein said first and second layers are made of different materials.

7. A high-pressure discharge lamp, according to claim 6, wherein said first layer has a thermal expansion coefficient that is between a thermal expansion coefficient of said electrode rod and a thermal expansion coefficient of said second layer and wherein said thermal expansion coefficient of said second layer is between said thermal expansion coefficient of said first layer and a thermal expansion coefficient of said bulb.

8. An intermediate part for sealing, in a bulb in a high pressure discharge lamp, an electrode assembly that includes an electrode rod, a lead electrode to the outside, and metal foil interposed between the electrode rod and the lead electrode, the intermediate part comprising:

a first portion that surrounds at least the metal foil and adheres to the electrode assembly; and a second portion that adhere to the bulb, wherein the first and second portions each have a thermal expansion coefficient that is between a thermal expansion coefficient of the electrode rods and a thermal expansion coefficient of the bulb.

9. An intermediate part according to claim 8, wherein the intermediate part is constructed of a glass material.

10. An intermediate part according to claim 8, wherein the intermediate part has a plurality of thermal expansion coefficients that decrease in order stepwise from the electrode assembly toward the bulb.

11. An intermediate part according to claim 8, wherein said first and second portions are made of different materials.

12. An intermediate part according to claim 11, wherein said first portion has a thermal expansion coefficient that is between a thermal expansion coefficient of the electrode rod and a thermal expansion coefficient of said second portion and wherein said thermal expansion coefficient of said second portion is between said thermal expansion coefficient of said first portion and a thermal expansion coefficient of the bulb.

* * * * *